US005919282A

United States Patent [19]

Hoshijima et al.

[11] Patent Number: 5,919,282

[45] Date of Patent: Jul. 6, 1999

[54] PROCESS FOR VACUUM REFINING MOLTEN STEEL AND APPARATUS THEREOF

[75] Inventors: Yosuke Hoshijima; Kazuo Oonuki; Kazuhisa Fukuda; Masao Iguchi, all of Himeji; Hidekazu Kakizoe, Kitakyushu; Hiroki Gofuku, Himeji; Hiroshi Nagahama, Himeji; Hiroaki Yamamoto, Himeji, all of Japan

[73] Assignee: Nippon Steel Corporation, Tokyo, Japan

[21] Appl. No.: 08/817,484

[22] PCT Filed: Aug. 28, 1996

[86] PCT No.: PCT/JP96/02413

§ 371 Date: Apr. 17, 1997

§ 102(e) Date: Apr. 17, 1997

[87] PCT Pub. No.: WO97/08348

PCT Pub. Date: Mar. 6, 1997

[30] Foreign Application Priority Data

| | | | |
|---|---|---|---|
| Aug. 28, 1995 | [JP] | Japan | 7-218357 |
| Sep. 26, 1995 | [JP] | Japan | 7-247199 |

[51] Int. Cl.[6] ..... C21C 7/10

[52] U.S. Cl. ..... 75/511; 266/210

[58] Field of Search ..... 75/511; 266/210

[56] References Cited

FOREIGN PATENT DOCUMENTS

| | | | |
|---|---|---|---|
| 0785284 | 7/1997 | European Pat. Off. . | |
| 5195043 | 8/1993 | Japan . | |
| 5171253 | 9/1993 | Japan . | |
| 5287359 | 11/1993 | Japan . | |
| 5345910 | 12/1993 | Japan . | |
| 6-73431 | 3/1994 | Japan | 266/210 |
| 665625 | 3/1994 | Japan . | |
| 741826 | 2/1995 | Japan . | |

*Primary Examiner*—Melvyn Andrews
*Attorney, Agent, or Firm*—Kenyon & Kenyon

[57] ABSTRACT

In a process for vacuum refining a molten steel wherein a refining flux is used, a fuel gas and an oxygen gas are spouted into the outlet of a top-blown lance of a vacuum refining apparatus to form a burner flame below the top-blown lance, and, at the same time, a refining flux is fed into the top-blown lance with the aid of an oxygen gas as a carrier gas and further passed through the burner flame, and the heated and melted refining flux is allowed to arrive at the surface of the molten steel. In this case, the refining flux feed rate and the circulating flow rate of the molten steel during vacuum refining are regulated so as to have a predetermined relationship, achieving a low flux consumption throughout a period of single refractory life of the vacuum tank.

18 Claims, 7 Drawing Sheets

PROCESS FOR VACUUM REFINING MOLTEN STEEL AND APPARATUS THEREOF

TECHNICAL FIELD

The present invention relates to a process for vacuum refining a molten steel in an RH vacuum degassing apparatus, a DH vacuum degassing apparatus and the like. In particular, the present invention provides a process and apparatus for vacuum refining a molten steel which can efficiently carry out a vacuum refining reaction of the molten steel with a refining flux.

An ever-increasing demand for meeting of a strict quality requirement of products in recent years has resulted in a demand for removal of impurities on the order of ppm. To cope with this demand, an attempt to extend the use of pretreatment of molten iron and secondary refining has been made in steelmaking processes.

For example, in order to produce an ultra low sulfur steel using an RH vacuum degassing apparatus, Japanese Unexamined Patent Publication (Kokai) Nos. 5-171253, 5-287359, 5-345910, and 6-65625 and the like disclose a refining flux projection method wherein a refining flux (a desulfurizer), together with an inert carrier gas, is blown through a top-blown lance against the surface of a molten steel circulated in a tank of an RH vacuum degassing apparatus equipped with the top-blown lance and allowed to forcibly enter into the molten steel, thereby desulfurizing the molten steel.

On the other hand, the applicant of the present invention has proposed, in Japanese Unexamined Patent Publication (Kokai) No. 7-41826, a method wherein a refining flux is projected on or added to the surface of a molten steel while heating the molten steel by means of a burner in a vacuum treatment apparatus to prevent a lowering in the temperature of the molten steel and to promote the melting of the refining flux, thereby improving the desulfurization efficiency.

In the same publication, the applicant has disclosed a technique where a top-blown lance, which can simultaneously spout a fuel gas, an oxygen gas for combustion of the fuel gas, and a refining flux (with the aid of an inert carrier gas such as argon gas), more particularly a top-blown lance comprising: a fuel gas feed hole provided in the divergent face at the lower end of a Laval lance for spouting an oxygen gas; and a refining flux introduction pipe provided within the passageway (axial center) of an oxygen gas, the spout of the refining flux being open into the divergent space, is disposed ascendably and descendably in a suspended state within a vacuum degassing tank, burner flame heating by the fuel gas and the oxygen gas and the projection of the refining flux are performed to preheat the refining flux by the heat of combustion (flame) in the burner until the refining flux reaches the surface of the molten steel, thereby promoting the melting of the refining flux within the molten steel to improve the desulfurization efficiency.

Japanese Unexamined Patent Publication (Kokai) No. 5-195043 discloses a method wherein a body of a plasma torch having a plasma electrode is provided in an RH degassing tank on its side wall above the surface of the molten steel, a flux feed pipe is provided on the body of the plasma torch to feed a refining flux into a plasma jet, and the flux is heated and/or melted with the plasma jet in the course of spouting until the flux reaches the surface on the molten steel, followed by introduction into the molten steel.

As described above, according to the conventional techniques, in vacuum refining of a molten steel using a refining flux (a desulfurizer) in a vacuum degassing apparatus, the refining flux is introduced into the surface of the molten steel with the aid of an inert gas as a carrier gas, and, when a refining flux is heated, burner combustion heat treatment by using the oxygen gas and the fuel gas or heat treatment by means of a plasma jet is conducted.

The reason why an inert gas is used as a carrier gas in the introduction of a refining flux, for example, a desulfurizer, into a molten steel is as follows.

In general, the desulfurization reaction of a molten steel is expressed by the following formula:

$$[S]+(CaO)=(CaS)+[O]$$

wherein [ ] represents that the component within [ ] is one contained in the molten steel and ( ) represents that the component within ( ) is one contained in the slag.

Therefore, in order to reduce the S content of the molten steel on the left side of the formula, it is necessary to conduct 1) the addition of lime as a desulfurizer (an increase in CaO) and 2) lowering in oxygen concentration in the molten steel. The addition of aluminum as a deoxidizer to the molten steel and the prevention of an increase in oxygen concentration of the molten steel caused by contact of oxygen in the atmosphere with the molten steel are necessary for reducing the oxygen concentration of the molten steel. This is the reason why the desulfurization reaction is said to be reduction refining.

For this reason, in the conventional desulfurization process, it is common practice to blow a desulfurization powder, through a nozzle inserted under the surface of the molten steel, into the molten steel with the aid of an inert carrier gas, such as nitrogen or argon, or to blow a desulfurization powder, through a lance disposed above the surface of the molten steel, against the surface of the molten steel. That is, the use of an oxygen gas as a gas for carrying the powder or as a gas for blowing against the surface of the molten steel leads to an increase in oxygen concentration of the molten steel and inhibition of the desulfurization reaction and, hence, has been considered irrational from the viewpoint of the principle. The introduction of a refining flux with the aid of an inert gas as a carrier gas in the surface of the molten steel according to the above technical common knowledge results in a lowered temperature of the molten steel due to the introduced inert gas or the powdery refining flux, which in turn results in a delayed metallurgical reaction of the refining flux, or, in the case of heating by taking advantage of burner combustion, lowers the temperature of a burner flame formed at the lower end of the lance and, consequently, causes lowered temperature of the refining flux which has arrived at the surface of the molten steel, resulting in lowered reaction efficiency of the refining flux.

On the other hand, the method wherein, before the refining flux arrives at the surface of the molten steel, a plasma torch is used for heating or melting the refining flux involves the following disadvantages:

1) A refining lance is additionally necessary for promotion of decarburization by blowing of oxygen or other purposes.
2) Special power source and control equipment for plasma are necessary.
3) In general, a lowering in pressure of the atmosphere results in lowered plasma introduction power. Consequently, the calorific value becomes small, rendering this method unsuitable for melting a large amount of powder.

Further, flux refining, in a vacuum refining apparatus, particularly flux refining involving the introduction of a desulfurizer, has a problem that a difference in results of refining occurs between refining in the above apparatus wherein the refractories constituting the vacuum tank are new and refining in the above apparatus wherein refractories constituting the vacuum tank have been significantly melt-lost due to repeated use for conventional degassing, even when both cases are identical to each other in composition of the molten steel before the desulfurization, composition of slag in the ladle, circulating gas blowing conditions, composition, particle size, and blowing conditions of the refining flux, and other conditions. That is, the former provides lower desulfurization ratio than the latter, indicating that, for the former, the refining flux consumption necessary for the desulfurization to a predetermined target value of not more than 10 ppm is higher than that in the latter.

In the above vacuum refining of a molten steel, refining, using a flux, which can be performed with a higher efficiency and, at the same time, is homogeneous throughout the refining period and, hence, can be performed in a short time, has been desired in the art.

DISCLOSURE OF INVENTION

Accordingly, an object of the present invention is to provide a more effective vacuum refining process.

Another object of the present invention is to provide a method and apparatus for compensating for a lowering in temperature of a molten steel in the course of refining using a flux in a versatile, simple system.

A further object of the present invention is to provide a refining process, using a flux in a vacuum tank, which can maintain the unit requirement of a refining flux at a low value throughout the life period of a refractory constituting the above vacuum tank, i.e., the period from the early period to the last period of the refractory (hereinafter referred to as "period of single refractory life").

According to the present invention, there is provided a refining process characterized by using a refining flux with the aid of an oxygen gas as a carrier gas. Specifically, the refining process comprises the steps of: blowing a refining flux (for example, a desulfurizer) with the aid of an oxygen gas as a carrier gas into a passageway of an oxygen gas in a top-blown lance provided in the top of a vacuum degassing tank; mixing the refining flux with the oxygen gas fed into the passageway of an oxygen gas; feeding a fuel gas into a passageway, of a fuel gas, passing through the top-blown lance and open in the vicinity of a spouting hole of the top-blown lance; mixing the mixed gas with the fuel gas in the vicinity of the spouting hole of the top-blown lance to form a flame; heating and melting the refining flux with the flame and then introducing the melted flux into a molten steel.

The reason why the oxygen gas is used as a carrier gas also in the desulfurization reaction as reduction refining is based on such novel fining that lowering the pressure of the atmosphere in the vacuum tank can lower the partial pressure of the oxygen gas which comes into contact with the molten steel, enabling the oxygen concentration of the carrier gas to be lowered.

Further, according to the present invention, since the fuel gas is completely burned utilizing also the oxygen gas as the carrier gas, the amount of a contaminant gas, which arrives at and contaminates the molten steel, is very small. Further, in the present invention, as described below, since a refining flux is heated and melted in a flame formed by the above combustion, the height of the top-blown lance is set at a predetermined value. The predetermined height of the lance leads to a decrease in flow rate of the combustion gas in the vicinity of the surface of the molten steel and makes it difficult for the combustion gas to arrive at the surface of the molten steel.

Even though the contaminant gas enters the surface of the molten steel, since the molten steel within the vacuum tank flows at a large flow rate in a turbulent flow state, the contaminant gas is immediately diffused in a molten steel, avoiding the influence of the contaminant gas on the melted flux material.

Further, the present inventors have made studies on conditions necessary for heating and melting the refining flux within the burner flame before the refining flux reaches the surface of the molten steel, that is, the quantity of heat fed per powder, particle size of the powder, melting point of the powder, height of the lance and the like, and, as a result, have enabled heat-melting of the refining flux by the burner flame according to the present invention.

By virtue of the above techniques, a significant lowering in temperature of the molten steel caused by the introduction of the refining flux could be prevented, and, at the same time, the refining flux consumption could be reduced.

Further, according to the present invention, the feed rate F of the refining flux and the circulating flow rate Q of the molten steel during the vacuum refining treatment are regulated to satisfy the following requirement, enabling the refining flux consumption to be kept low throughout the period of single refractory life constituting the vacuum tank:

$$0.5 \leqq F/Q \leqq 1.5.$$

It is a matter of course that, when F and Q are maintained in the above range, the molten steel within the vacuum tank can be satisfactorily circulated, removing a harmful effect caused by the entry of the contaminant gas into the molten steel.

BEST MODE FOR CARRYING OUT THE INVENTION

Figure 1:
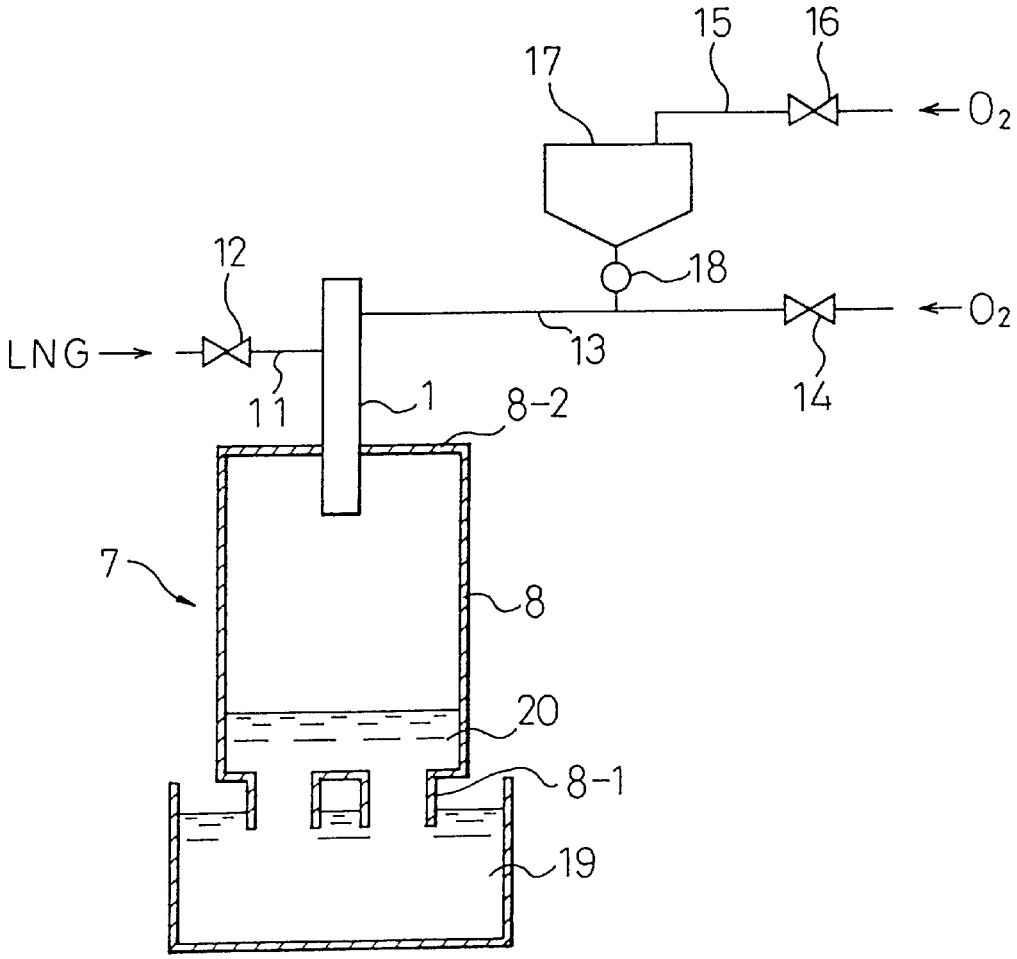
FIG. 1 is a front view partly in section of one embodiment of the RH vacuum degassing apparatus for carrying out the present invention.

The present invention resides in a refining process wherein an oxygen gas, which has been considered unusable particularly in refining using a flux in reduction refining, is used as a carrier gas of a refining flux to conduct temperature compensation of the molten steel and to enhance the refining reaction of the flux. Such an idea of use of an oxygen gas as the carrier gas has been made based on the following technical recognition.

Specifically, the use of the oxygen gas in an atmosphere under reduced pressure can reduce the partial pressure of the oxygen gas which comes into contact with the molten steel. For example, in an RH vacuum degassing process, that the pressure of the atmosphere is 5 torr is equivalent to, even when the atmosphere consists of an oxygen gas alone, an oxygen concentration under atmospheric pressure which is reduced to 0.6%. The lower the oxygen concentration of the gas which comes into contact with the molten steel, the better the results. Investigations conducted by the present inventors, however, have revealed that, during treatment by the RH vacuum degassing process, an oxygen concentration of less than 1% can eliminate the contamination of the molten steel with oxygen.

As described above, when the pressure of the atmosphere within the vacuum degassing tank in the vacuum refining apparatus is not more than 5 torr, this pressure corresponds to an oxygen concentration of not more than 0.6% under atmospheric pressure, preventing the contamination of the molten steel with oxygen. The present invention is based on such technical recognition that reducing the pressure of the atmosphere within the tank enables the partial pressure of the oxygen gas, which comes into contact with the molten steel, to be reduced to such an extent as will not pose a problem of contamination of the molten steel with oxygen.

Such recognition is novel one contradictory to technical common knowledge in reduction refining, such as desulfurization refining, and the present invention could not have been made without such technical recognition.

Based on the above technical recognition, in the refining process using a flux, the degree of vacuum in a vacuum degassing tank is brought to 3 to 200 torr. When the degree of vacuum is lower than 200 torr, the molten steel cannot be drawn up into the degassing tank, inhibiting the circulating flow of the molten steel and, at the same time, resulting in remarkable contamination of the molten steel with oxygen. On the other hand, when the degree of vacuum is high and less than 3 torr, the flame ejected from the opening of the outlet of the top-blown lance becomes rapidly long, increasing the time of contact of the flame with the molten steel. This results in rapid increase of contamination of the molten steel with carbon. For the above reason, the degree of vacuum within the tank is limited to the above range. When the molten steel after refining is of such a type that contamination with oxygen or carbon should be completely prevented and when efficient refining in a short time is contemplated, the degree of vacuum within the tank is brought to 70 to 150 torr. When some contamination may be tolerated depending upon the type of steels, the degree of vacuum may be selected in the range of from 3 to less than 70 torr or more than 150 to 200 torr depending upon the type of steels.

Further, the distance between the outlet of the top-blown lance and the surface of the molten steel (height of lance) and the circulating flow rate of the molten steel in the vacuum refining apparatus can be suitably regulated to surely prevent the contamination.

Furthermore, based on the above recognition, according to the present invention, a fuel gas spouted in the vicinity of the outlet of the top-blown lance is completely burned with an oxygen gas including the above carrier gas to minimize the contamination of the molten steel by oxidation with the combustion gas (such as carbon dioxide and water vapor).

Furthermore, the refining flux is heated and melted within the combustion gas to evenly distribute elements constituting the flux within the flux particles and, in this state, is introduced into the molten steel to permit the flux constituting elements to be evenly distributed within the molten steel.

Conditions for heating and melting the refining flux within the combustion gas (flame) will be described.

(1) In the present invention, in order to melt the flux within the flame, the distance LH between the opening of the lower end of the top-blown lance and the molten steel, that is, the height of lance (height of operating burner) should be increased to ensure the melting time. In this connection, the following formula has been established based on the calculation regarding the heat transfer to the flux in the flame and the results of observation of the state of melting of the flux.

$$LH>3500-6.18\times D_2+224\times(D_2/D_1)+1.13\times F-11.58\times P$$

wherein LH represents the height of the lance, mm; $D_1$ represents the diameter of a lance throat, mm; $D_2$ represents the diameter of output of the lance, mm; F represents the flow rate of oxygen, $Nm^3/hr$; and P represents the pressure of atmosphere, torr. Based on this formula, the oxygen flow rate and the pressure of the atmosphere (contamination with oxygen or carbon being taken into consideration) are regulated to determine a desired LH value.

(2) The quantity of heat fed per flux has been calculated based on the following formula has been established based on the calculation regarding the heat transfer to the flux in the flame and the results of observation of the state of melting of the flux:

670 kcal/kg-flux (LNG/kg-flux: corresponding to 0.067 $Nm^3$)

The quantity of heat larger than this value should be fed into the flame.

(3) Regarding the particle size of the flux, the diameter of each flux particle is regulated to not more than 0.25 mm, preferably not more than 0.14 mm. This particle size corresponds to not more than 100 mesh. This particle size also has been calculated based on the calculation regarding the heat transfer to the flux in the flame and the results of observation of the state of melting of the flux.

(4) The melting point of the flux is regulated. Specifically, the flux (desulfurizer) used in a working example of the present invention has a composition of 80% CaO and 20% $CaF_2$, and the melting point estimated from the phase diagram is about 2000° C. Therefore, a flux having a melting point of this value or below may be applied.

A test on the melting of a refining flux was conducted under conditions falling within the scope of the present invention, that is, such conditions that a flux, of 40% $CaF_2$-60% CaO, having a particle size of not more than 100 mesh was used as the desulfurizer, the fuel gas was LNG 100 $Nm^3$/hr and the height of the burner was 6 m.

Figure 12A:
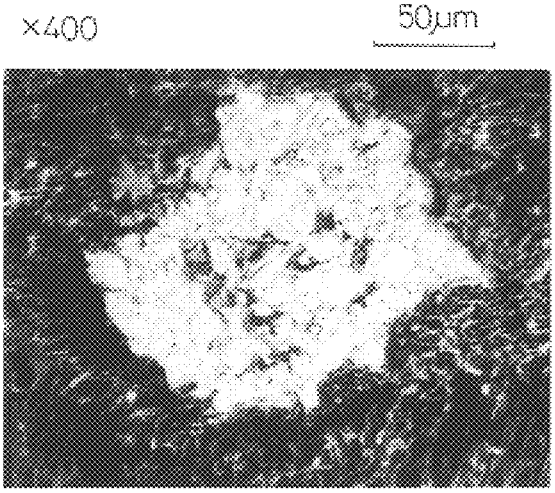
FIG. 12(A) is a reflection electron photomicrograph showing the section of a flux powder before melting.
Figure 12B:
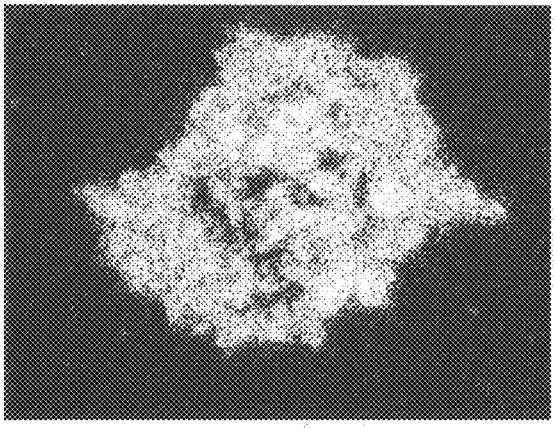
FIG. 12(B) is a reflection electron photomicrograph showing the element distribution of Ca constituting the flux powder shown in FIG. 12(A)

The appearance of the flux powder before introduction into the flame was non-spherical as shown in FIG. 12(A) and had significant irregularities on the surface thereof. Further, the distribution of Ca within the particle is heterogeneous as shown in FIG. 12(B).

Figure 13A:
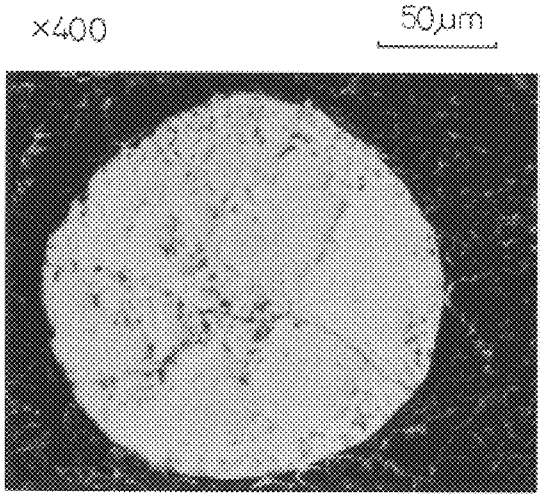
FIG. 13(A) is a reflection electron photomicrograph showing the section of a flux powder after melting.
Figure 13B:
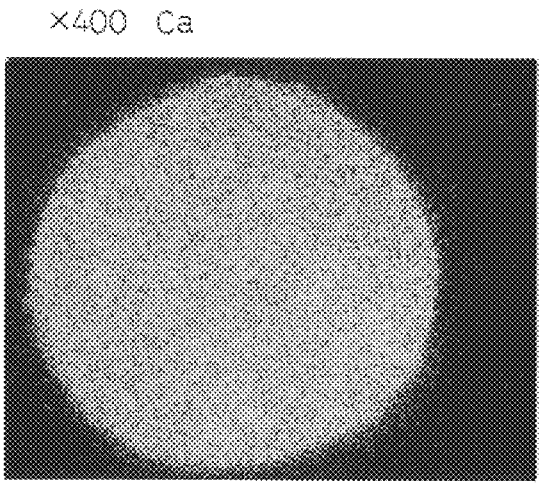
FIG. 13(B) is a reflection electron photomicrograph showing the element distribution of Ca constituting the flux powder shown in FIG. 13(A).

The introduction of the above flux under the above conditions into the flame brought the flux powder form to a glossy sphere as shown in FIG. 13(A) and rendered the distribution of Ca within the sphere homogeneous as shown in FIG. 13(B). The same distribution could be attained also for other components, F and O, confirming that all the flux constituents have been homogenized.

As a result, the flux becomes an agglomerate of spheres which enters the molten steel and is immediately diffused and dissolved, resulting in a very rapid and effective desulfurization reaction in the molten steel.

Thus, the introduction of a refining flux with the aid of oxygen as a carrier gas into a burner flame raises the temperature of the burner flame, the temperature of the flux, and the temperature of the molten steel, improving the reaction efficiency of the refining flux. In addition, regarding the system, the top-blown lance of the vacuum refining apparatus as such can be utilized without additionally providing other equipment, offering a great advantage that the system is very simple and the process can be carried out at a low cost.

The present invention will be described in more detail with reference to the accompanying drawings.

Figure 3:
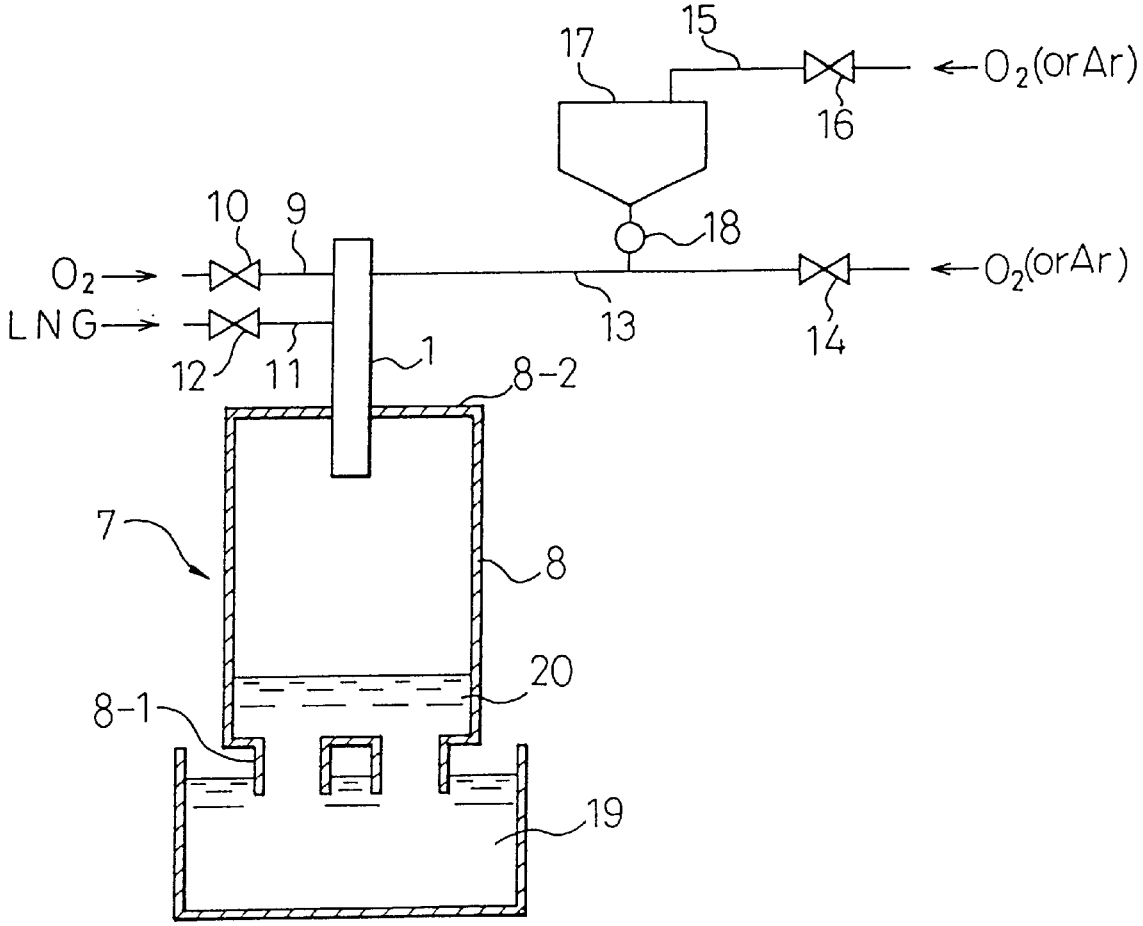
FIG. 3 is a front view partly in section of another embodiment of the RH vacuum degassing apparatus for carrying out the present invention.
Figure 4:
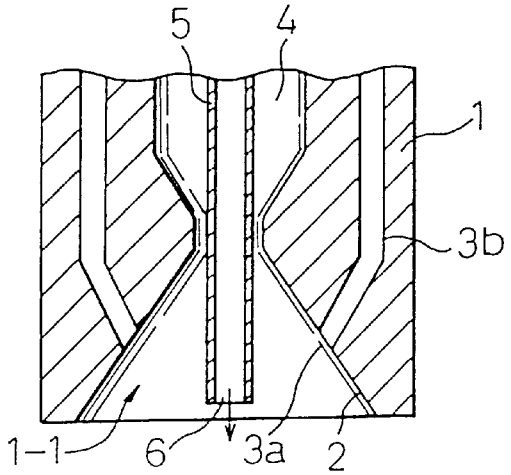
FIG. 4 is a cross-sectional view of the end portion of the top-blown lance shown in FIG. 3.

At the outset, to confirm the difference in effect between the use of oxygen as the carrier gas according to the present invention and the use of an argon gas as the carrier gas according to the prior art, the following refining test was performed using an apparatus shown in FIGS. 3 and 4.

FIG. 3 shows a vacuum refining apparatus and a flux/gas feed system for feeding a refining flux, a fuel gas, and an oxygen gas for combustion of the fuel gas.

A vacuum refining apparatus 7 comprises a vacuum tank 8 having an immersion pipe 8-1 immersed in a molten steel 20 contained in a ladle 19, and a top-blown lance 1 ascendably and descendably provided in the top 8-2 of the vacuum tank 8. As shown in FIG. 4, the top-blown lance 1 comprises a passageway 4, of an oxygen gas, provided in the axial center thereof, and a plurality of passageways 3*b*, of a fuel gas, provided in the interior of the wall of the lance, the passageways 3*b* each having a fuel gas feed hole 3*a* open into a divergent surface 2 at the lower end of the lance. Further, a refining flux introduction pipe 5 is provided within the passageway 4 of an oxygen gas, and the spout 6 thereof is open into a space (opening) 1-1 defined by the divergent surface 2.

The passageway 4 of an oxygen gas is connected to an oxygen gas feed pipe 9, and oxygen is fed through a valve 10. The passageways 3*b* of a fuel gas are connected to a fuel gas feed pipe 11, and a fuel gas is fed through a valve 12. The refining flux introduction pipe 5 is connected to a carrier gas feed pipe 13, and a carrier gas is fed through a valve 14. A refining flux tank 17 is connected through a valve 18 to the carrier gas feed pipe 13 between the top-blown lance 1 and the valve 14, and the system is constructed so that a carrier gas is fed from the carrier gas feed pipe 15 connected to the tank 17 into the tank 17 through the valve 16 to feed the refining flux from the tank 17 into the carrier gas feed pipe 13.

In the above apparatus and system, a predetermined amount of the refining flux is fed from the refining flux tank 17 into the carrier gas feed pipe 13 with the aid of the carrier gas, and the refining flux, together with the carrier gas, is fed into the refining flux introduction pipe 5 provided within the top-blown lance.

Further, an oxygen gas for combustion of a fuel gas is fed from the oxygen gas feed pipe 9 into the passageway 5 of an oxygen gas in the top-blown lance, and, in addition, a fuel gas is fed from the fuel gas feed pipe 11 into the passageway 3*b* of a fuel gas. The oxygen gas, the fuel gas, and the refining flux are simultaneously spouted into the opening 1-1 in the outlet of the top-blown lance. This results in the formation of a burner flame below the top-blown lance 1 and above the surface of the molten steel, and, at the same time, the refining flux is passed through the burner flame where it is heated and melted. The refining flux in a melted state arrives at the surface of the molten steel within the vacuum tank.

In this connection, two refining tests were carried out. In one of the refining tests, the above apparatus and system were used, argon gas was used as the carrier gas fed through the feed pipes 13, 15, and a refining flux was used as the desulfurizer and spouted with the aid of an argon gas as the carrier gas. In the other refining test, an oxygen gas was used as the carrier gas fed through the feed pipes 13, 15, and the refining flux was spouted with the aid of the oxygen gas as the carrier gas. In these tests, the desulfurization ratio was investigated based on an identical unit requirement of the flux.

The amount of the molten steel under test was 108 tons, and the steel used was an aluminum killed steel. The refining flux used had a composition of 80% lime-20% fluorspar, and the size of the flux powder was not more than 100 mesh.

The lower end of the top-blown lance 1 having a Laval structure, wherein the form of the front end was such that the throat diameter was 18 mm and the outlet diameter was 90 mm, was disposed at a height of 6 m based on the stationary molten steel surface. LNG was used as the fuel gas, fed at a flow rate of 200 $Nm^3$/hr into the passageway of a fuel gas in the top-blown lance 1, and spouted through the fuel gas feed hole 3*a*. The oxygen gas was fed into the passageway 4 of an oxygen gas at a flow rate of 460 $Nm^3$/hr, a flow rate high enough to completely burn the combustion gas, and spouted through the axial center of the lance.

The refining flux feed rate was 30 kg/min, the unit requirement of the flux was 2 kg/ton, the molten steel circulating rate was 40 ton/min, and the flow rate of the carrier gas for the refining flux (the amount of the carrier gas spouted through the refining flux introduction pipe 5) was 240 $Nm^3$/hr.

When the carrier gas for the refining flux was an oxygen gas, the flow rate of the oxygen gas spouted through the passageway 4 of an oxygen gas was regulated so that the total flow rate of the oxygen gas spouted as the carrier gas and the oxygen gas spouted through the passageway 4 of an oxygen gas in the top-blown lance 1 was 460 $Nm^3$/hr. In the test, the content of T. Fe in slag within the ladle 19 was not more than 3%.

The results of investigations on the desulfurization ratio are summarized in Table 1. It has been found that, as compared with the argon gas carrier, the oxygen gas carrier was higher in desulfurization ratio defined by the following equation and could offer more efficient desulfurization refining.

Desulfurization ratio=(S content of molten steel before treatment−S content of molten steel after treatment)÷(S content of molten steel before treatment)×100

TABLE 1

| Flux feed system | Carrier gas | Desulfurization ratio |
|---|---|---|
| Fed into flux introduction pipe incorporated in top-blown lance | Argon gas | 45% |
| Fed into flux introduction pipe incorporated in top-blown lance | Oxygen gas | 70% |
| Fed into oxygen gas feed pipe of burner lance | Oxygen gas | 80% |

The reason why an 25% improvement in desulfurization ratio based on an identical the flux consumption could be attained by changing the carrier gas for the refining flux from the argon gas to the oxygen gas is believed to reside in that, by virtue of the exclusion of the argon gas, which is unnecessary for the combustion and lowers the temperature of the burner flame, the temperature of the burner flame formed below the lower end of the lance and above the surface of the molten surface is raised resulting in raised temperature of the refining flux at the time of arrival at the surface of the molten steel and thus improving the reaction efficiency of the refining flux.

As described above, carrying the refining flux using the refining flux introduction pipe 5 with the aid of an oxygen gas as the carrier gas through the top-blown lance can offer a refining effect unattainable by the prior art and, in addition, an additional advantage that measures can be easily taken against the abrasion of the inner wall of the top-blown lance created by the powder. However, the structure is complicated, and measures should be taken against the melt loss of the introduction pipe caused by exposure to the high temperature.

Figure 2:
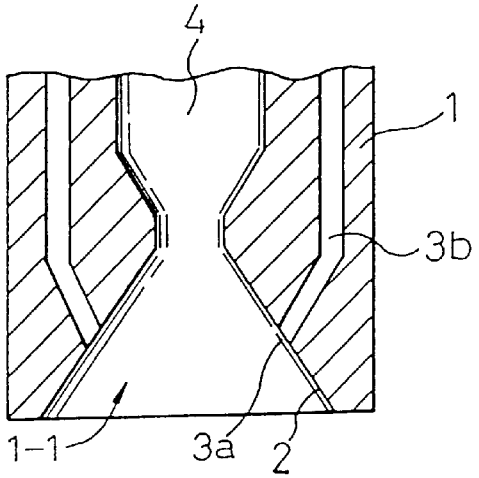
FIG. 2 is a cross-sectional view of the end portion of the top-blown lance shown in FIG. 1.

For this reason, in the present invention, the refining flux introduction pipe 5 shown in FIG. 2 was removed, and, as shown in FIGS. 1 and 2, a refining flux feed apparatus and system were constructed wherein the carrier gas feed pipe 13 was connected to and opened into the top of the passageway 4 of an oxygen gas to permit the refining flux to be fed directly into the passageway 4 of an oxygen gas. This eliminates the need to use the oxygen gas feed pipe 9 for feeding the oxygen gas for combustion of the fuel gas, and both the refining flux and the oxygen gas for combustion of the fuel gas are fed through the carrier gas feed pipe 13 into the passageway 4 of an oxygen gas.

According to the vacuum refining apparatus having the above construction, in the passageway 4 of an oxygen gas, the refining flux is homogeneously dispersed in and mixed with the oxygen gas and, at the same time, mixed with the fuel in the opening 1-1 of the outlet in the top-blown lance. Therefore, no discontinuous pressure is created at the outlet of the top-blown lance, resulting in the formation of a stable flame and homogenous heating of each dispersed particle of the refining flux.

Using the vacuum refining apparatus having the above construction, a vacuum refining test was carried out wherein the top-blown lance 1 had a throat diameter of 18 mm and an outlet diameter of 90 mm, the flow rate of oxygen gas, including the oxygen gas as the carrier gas for the refining flux, spouted through the lance was 460 $Nm^3$/hr and the other conditions were the same as described above. The results are also summarized in Table 1.

As is apparent from the results given in Table 1, as compared with the feed of the refining flux with the aid of an oxygen gas as the carrier gas through the top-blown lance 1 incorporating the flux introduction pipe 5, the feed of the refining flux using an oxygen gas, for combustion of a fuel gas, as the carrier gas into the carrier gas feed pipe 13 connected to the burner lance have offered a 10% improvement in desulfurization ratio, resulting in more efficient desulfurization refining.

As described above, this is derived from homogeneous heat transfer by virtue of homogeneous dispersion of the refining flux into the burner flame. In fact, the refining flux particles have been spheroidized, and constituents of the flux, for example, fluorine and Ca, have been homogeneously distributed within the particle.

More specifically, it is considered that, according to the above embodiment of the present invention, the average temperature of a group of flux particles for refining until arrival at the surface of the molten steel is raised, and the flux is melted by the heat, so that, after the arrival of the refining flux at the surface of the molten steel, the rate of diffusion of S, a target element in the refining, into the flux is increased to increase the concentration of S in the flux, resulting in improved reaction efficiency of the refining flux and improved desulfurization ratio based on an identical unit requirement.

In the vacuum refining apparatuses, shown in FIG. 1 to 4, according to embodiments of the present invention, besides the arrival of the refining flux at the surface of the molten steel after heating or after heating and melting, heating of the molten steel and refractories by burner combustion, and the promotion of decarburization and raising the temperature of aluminum by blowing of an oxygen gas alone may be used.

The present inventors have made a test on flux refining using the above RH vacuum degassing apparatus and, as a result, have further found the following phenomenon. Specifically, a difference in results of refining occurred between refining in the above apparatus wherein the refractories constituting the vacuum tank were new and refining in the above apparatus wherein refractories constituting the vacuum tank had been significantly melt-lost due to repeated use for conventional degassing, even when both cases were identical to each other in composition of the molten steel before the refining with the flux, composition of slag in the ladle, circulating gas blowing conditions, composition of the refining flux, particle size, and blowing conditions and other conditions. That is, the reaction efficiency of the former flux refining was lower than that of the latter flux refining, and, for example, for the former, the refining flux consumption necessary for the desulfurization to a predetermined target value of not more than 10 ppm was higher than that for the latter.

Another aspect of the present invention has been made based on the elucidation of the above phenomenon. Specifically, a process for vacuum refining a molten steel, which is a process attained by further improving the above flux refining process, is provided wherein, in the above flux refining, also in refining in a period where refractories constituting the vacuum tank are new, a flux refining reaction comparable with that in refining in a period where refractories constituting the vacuum tank have been significantly melt-lost, is ensured to enable the refining of a low refining flux consumption comparable with that in refining in a period where refractories constituting the vacuum tank have been significantly melt-lost.

The present inventors have made various studies on the above phenomenon and, as a result, have noticed that there is a difference in the state of an RH immersion ripe between the early period and the last period in the single refractory life constituting the RH vacuum tank. Specifically, as compared with the RH immersion pipe in the early period of the single refractory life constituting the RH vacuum tank, the RH immersion pipe in the last period of the single refractory life constituting the RH vacuum tank had an increased inner diameter due to melt loss, resulting in increased circulating flow rate of the molten steel. Based on this fact, investigations and studies have been made on the relationship among the circulating flow rate of the molten steel, the feed rate of the refining flux, the efficiency of refining with flux, and the unit requirement of the flux for refining, calculated based on measured values of the inner diameter of the immersion pipe immediately after the experiment.

As a result, it has been found that, in a process for vacuum refining a molten steel, wherein a refining flux is blown against the surface of a molten steel through a top-blown lance with the aid of a carrier gas, the regulation of the flux feed rate F and/or the circulating flow rate Q of the molten steel so as for the flux feed rate F and the circulating flow rate Q of the molten steel during the vacuum refining treatment to satisfy a requirement represented by the following formula can stably offer a high efficiency of refining with a flux throughout the period of single refractory life constituting the vacuum tank and enables, for example, an ultra low sulfur molten steel having a sulfur content of not more than 10 ppm to be produced in a low refining flux consumption:

$$0.5 \leqq \text{flux feed rate } F \text{ (kg/min)} + \text{circulating flow rate of molten steel } Q \text{ (t/min)} \leqq 1.5.$$

In connection with the period of single refractory life, the time when new refractories have been used for constituting the RH vacuum tank is defined as the beginning of the period of single refractory life, while the time when the vacuum tank has been replaced for newly constructing the attrited refractories is defined as the end of the period of single refractory life.

Phenomena observed in the refining with a flux in the period of single refractory life were confirmed by the following experiment.

Figure 5:
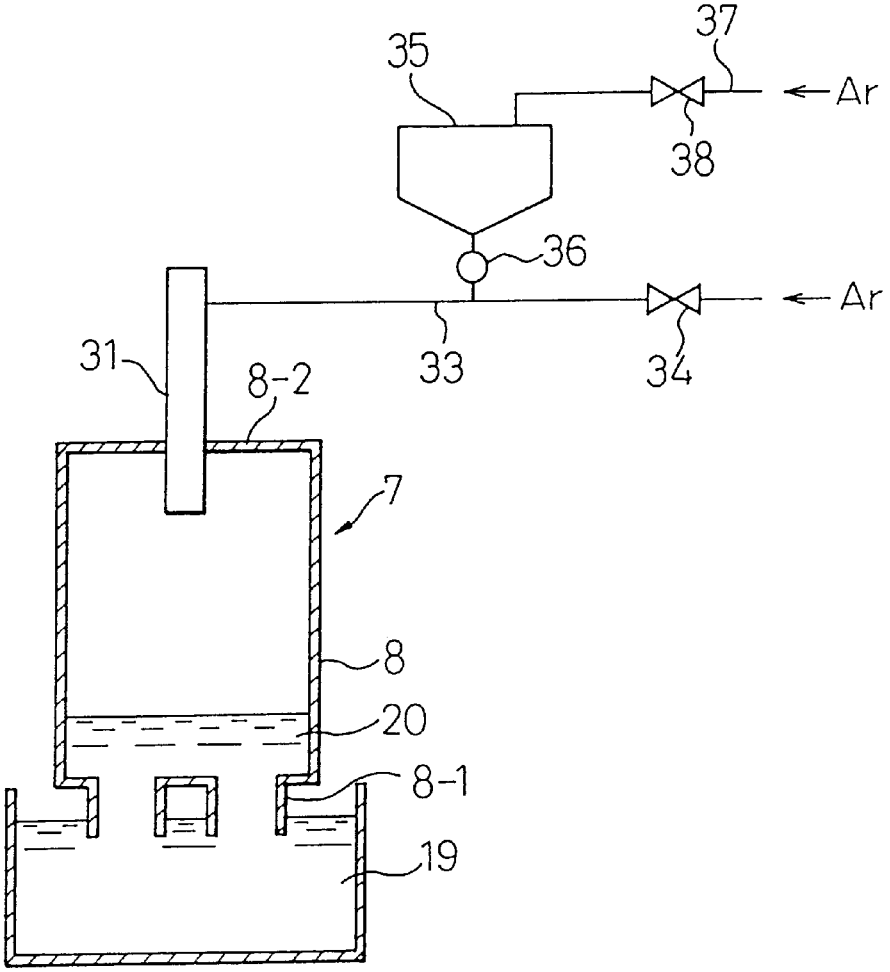
FIG. 5 is a front view partly in section of an RH vacuum degassing apparatus.
Figure 6:
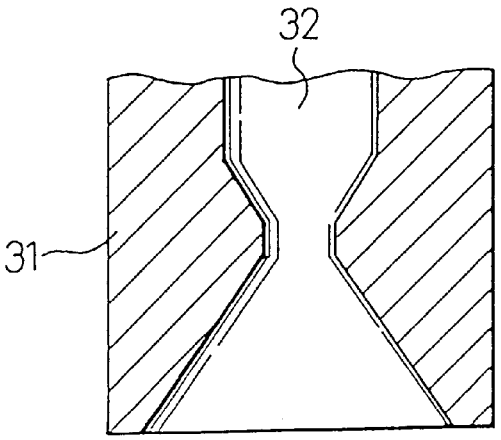
FIG. 6 is a cross-sectional view of the end portion of the top-blown lance shown in FIG. 5.

The present inventors have conducted a test wherein a top-blown lance 31 having a Laval structure shown in FIG. 6 was disposed in a suspended state within a vacuum tank 8 of an RH system having a production capacity of 100 tons as shown in FIG. 5 and a desulfurizing flux powder was passed through the lance 31 with the aid of an argon gas as a carrier gas and blown against the surface of a molten steel 20 contained in the vacuum tank and circulated through an immersion pipe 8-1 immersed in the molten steel 20 contained in the ladle 19, thereby conducting vacuum desulfurization.

In FIG. 5, a carrier gas feed pipe 33 is connected through a valve 34 to a passageway 32 of a carrier gas in the top-blown lance 31, a flux tank 35 is connected through a valve 36 to the feed pipe 33, and a carrier gas feed pipe 37 is connected through a valve 38 to the tank 35.

The flux used had a composition of 60% lime-40% fluorspar, and the size of the flux powder was not more than 100 mesh. The lance was as shown in FIG. 6 and had a throat diameter of 18 mm and an outlet diameter of 90 mm. The flow rate of the carrier gas was 300 $Nm^3$/hr. The height of the lance was 2.3 m from the surface of the molten steel within the vacuum tank.

The composition of slag in the ladle and the amount of the flux used were such that the content of T. Fe+MnO in the slag was not more than 5%, the unit requirement of the flux was about 2 kg/ton and the flux feed rate was 70 kg/min. The molten steel used has a composition specified in Table 2 and treated at a temperature of about 1600° C.

The present inventors have continuously conducted testing through the period of single refractory life constituting the RH vacuum tank. As a result, in the early period where the refractories are new and in the last period where the refractories have been significantly melt-lost, despite the treatment under an identical unit requirement of the desulfurizing flux and identical treatment conditions, as is apparent from Table 3, the desulfurization ratio in the last period was higher than that in the early period.

On the other hand, in a desulfurization test wherein the flux feed rate was changed to 25 kg/min and 40 kg/min, unlike the above test using a flux feed rate of 70 kg/min, the desulfurization ratio was high for both the last period and the early period of the refractory constituting the vacuum tank.

TABLE 2

| C | Si | Mn | sol.Al |
|---|---|---|---|
| 0.0030% | 3.0% | 0.20 | 0.300 |

TABLE 3

| Period of single refractory life | Average desulfurization ratio |
|---|---|
| Early | 40% |
| Middle | 45% |
| Last | 71% |

(CaO-40% $CaF_2$: 2 kg/ton)

Figure 7:
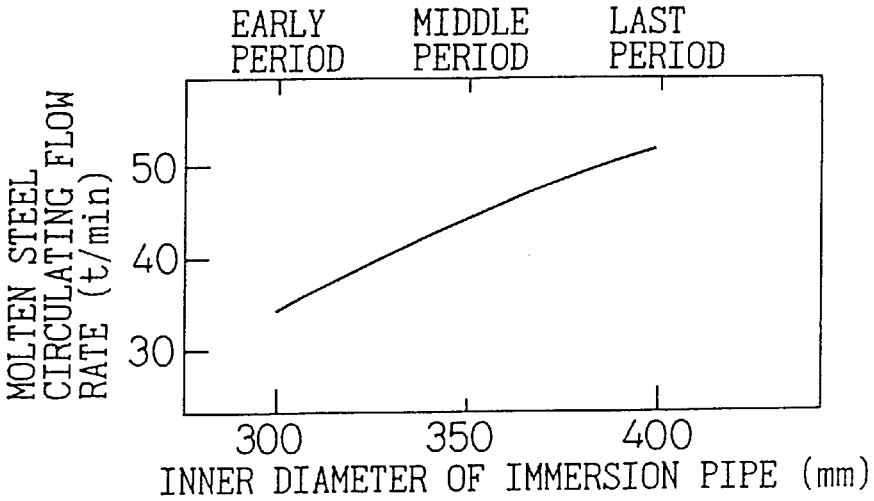
FIG. 7 is a diagram showing the relationship between the inner diameter of an immersion pipe and the circulating flow rate of the molten steel in the apparatus shown in FIG. 5 and the relationship between the period of the single refractory life and the circulating flow rate in the above apparatus.

As is well known, as compared with the inner diameter of the RH immersion pipe 8-1 at the time of construction of a new furnace, the inner diameter of the RH immersion pipe 8-1 in the last period of the single refractory life of the furnace is larger due to the occurrence of melt loss. Further, in general, in the RH treatment, the circulating gas flow rate is set at a constant value independently of the melt loss of the RH immersion pipe, and the circulating flow rate of the molten steel depends upon the inner diameter of the immersion pipe. FIG. 7 shows the relationship between the inner diameter of the immersion pipe and the circulating flow rate of the molten steel in the early period, the middle period, and the last period in the single refractory life constituting the RH vacuum tank in an RH system (circulating gas flow rate: 500 Nl/min (constant)) having a production capacity of 100 tons used in the above desulfurization test. From FIG. 7, it is apparent that the circulating flow rate of the molten steel is gradually increased from the early period to the last period of the single refractory life.

Figure 8:
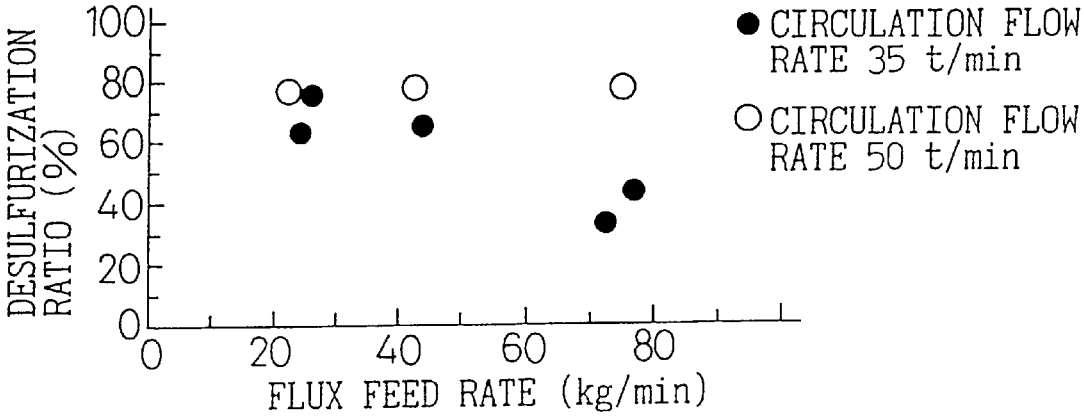
FIG. 8 is a diagram showing the relationship between the flux feed rate and the desulfurization ratio in the apparatus shown in FIG. 5.

Accordingly, the present inventors have stratified the results of the above desulfurization tests based on an identical circulating flow rate of the molten steel and investigated the relationship between the flux feed rate and the desulfurization ratio. The results are shown in FIG. 8. As can be seen from FIG. 8, when the circulating flow rate of the molten steel was large, the desulfurization ratio was constant regardless of the flux feed rate, whereas when the circulating flow rate of the molten steel was small, increasing the flux feed rate resulted in lowered desulfurization ratio and lowered desulfurization efficiency.

Figure 9:
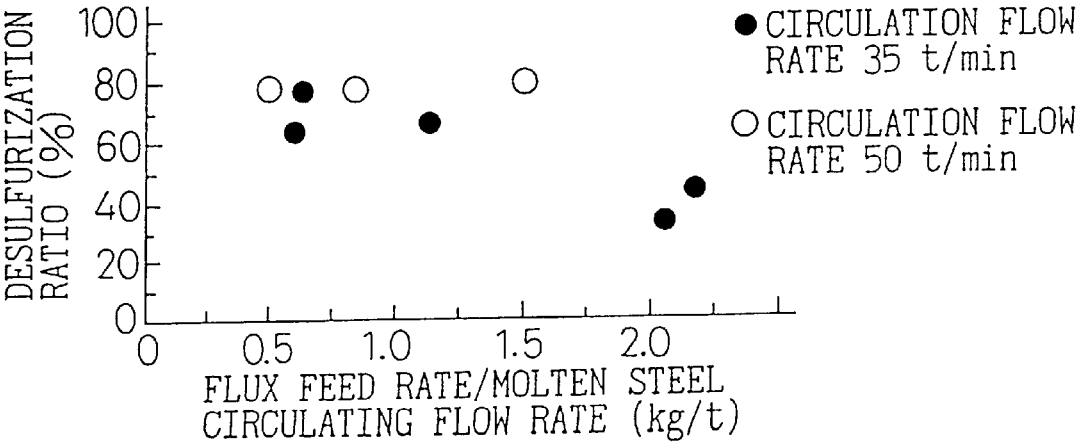
FIG. 9 is a diagram showing the relationship between the ratio of the flux feed rate to the circulating flow rate of the molten steel and the desulfurization ratio in the apparatus shown in FIG. 5.

This phenomenon suggests that there is an optimal relationship between the feed of the flux and the flow of the molten steel. Therefore, the relationship between the ratio of the flux feed rate F (kg/min) to the circulating flow rate Q (ton/min) of the molten steel and the desulfurization ratio was arranged and is shown in FIG. 9. In the following description, F represents the flux feed rate, and Q represents the circulating flow rate of the molten steel.

When the ratio of the flux feed rate to the circulating flow rate of the molten steel is not more than 1.5, the desulfurization ratio can be maintained on a high level. When it exceeds 1.5, the desulfurization ratio is lowered.

This is probably because the flow of the molten steel is slow relative to the feed of the flux, inhibiting the dispersion of the flux and thereby resulting in lowered interfacial area involved in the desulfurization reaction.

Based on the above finding, the present inventors performed an experiment, using the RH system shown in FIG. 5, wherein, throughout the period of single refractory life constituting the RH vacuum tank, before the initiation of the vacuum treatment, the inner diameter of the RH immersion pipe was measured, the estimated circulating flow rate of the molten steel was calculated, and vacuum desulfurization was carried out while regulating the flux feed rate so as to give a ratio of the flux feed rate to the circulating flow rate of the molten steel of not more than 1.5 during the vacuum desulfurization depending upon the circulating flow rate of the molten steel. The period of single refractory life constituting the vacuum tank, the circulating flow rate of the molten steel, the flux feed rate, the ratio of the flux feed rate to the circulating flow rate of the molten steel, and the desulfurization ratio in the above experiment are summarized in Table 4.

Further, data on the desulfurization ratio given in Table 3 showing the results of an experiment using a constant flux feed rate, without regulation, throughout the period of single refractory life, together with the flux feed rate and the ratio of the flux feed rate to the circulating flow rate of the molten steel, are also given in Table 4.

As is apparent from Table 4, when the flux feed rate is regulated so as to give a ratio of the flux feed rate to the circulating flow rate of the molten steel of not more than 1.5 during the vacuum desulfurization, the desulfurization ratio can be stably maintained on a high level with the unit requirement of the flux being stably maintained on a low level throughout the period of single refractory life constituting the RH vacuum tank.

The regulation of the ratio of the flux feed rate to the circulating flow rate of the molten steel during each vacuum desulfurization throughout the period of single refractory life constituting the vacuum tank to not more than 1.5 was made by regulating the flux feed rate. The same effect can be attained by a combination of the regulation of the flux feed rate in combination with the regulation of the circulating flow rate of the molten steel or by regulating the circulating flow rate of the molten steel alone.

One example of the method for regulating the circulating flow rate of the molten steel is to use the following equation. The circulating flow rate of the molten steel is the mass flow rate (ton/min) of the molten steel circulating between the RH vacuum tank and the ladle.

$$Q=11.4\times G^{1/4}\times D^{4/3}\times\{ln(P_1/P_0)\}$$

wherein Q: circulating flow rate of the molten steel (ton/min), G: flow rate of Ar gas for circulation (Nl/min), D: inner diameter of immersion pipe (m), $P_1$: 760 (torr), and $P_0$: degree of vacuum within the tank (torr).

Therefore, the circulating flow rate of the molten steel can be regulated by controlling the flow rate of Ar gas for circulation and the degree of vacuum within the tank.

The lower limit of F/Q is 0.5. When the F/Q value is lower than 0.5, the flux flow rate is so low that the time of refining with a refining flux becomes long resulting in increased heat load of the refractory, which is causative of the attrition of the refractory. Otherwise, the circulating flow rate rate of molten steel is extremely large, unfavorably accelerating the attrition of the refractory of the immersion pipe.

Next, the present inventors have made the following test, with reference to the above test results, using the vacuum refining apparatus and system shown in FIGS. 3 and 4.

Since heat transfer to the flux is promoted in a combustion flame, 2 kg/ton of a flux having a composition of 80% CaO-20% $CaF_2$ was used as a flux which is less likely to be melted. The flow rate of the oxygen-containing gas in the burner was 460 $Nm^3$/hr in terms of pure oxygen, and LNG was used as the fuel gas at a flow rate of 200 $Nm^3$/hr which was high enough to be completely burned by the oxygen used. The carrier gas for the refining flux was an argon gas (flow rate 180 $Nm^3$/hr), oxygen enriched air (flow rate 180 $Nm^3$/hr at oxygen enrichment of 60%), or a pure oxygen gas (flow rate (as a carrier gas) 180 $Nm^3$/hr), and the circulating flow rate of the molten steel was 35 tons/min. When the oxygen-containing gas or the pure oxygen gas was used as the carrier gas, the total flow rate of pure oxygen spouted from the lance was regulated to 460 $Nm^3$/hr.

In the above lance, since a burner flame portion is formed, below the lance, following a jet core portion, the formation of the whole length of the burner flame below the lance and above the surface of the molten steel is preferred from the

TABLE 4

| | Process of inv. | | | | Conventional process | | |
|---|---|---|---|---|---|---|---|
| Period of single refractory life | Estimated circulating flow rate Q, ton/min | Flux feed rate F, kg/min | F/Q | Desulfurization ratio, % | Flux feed rate F, kg/min | F/Q | Desulfurization ratio, % |
| Early | 34 | 61 | 1.50 | 70 | 70 | 2.06 | 40 |
| Middle | 43 | 64 | 1.49 | 70 | 70 | 1.63 | 45 |
| Last | 51 | 76 | 1.49 | 71 | 70 | 1.37 | 71 |

(Flux: CaO-40% $CaF_2$ powder, 2 kg/ton)

viewpoint of heating the flux. Therefore, the lance was positioned at a height of 6 m so as to ensure that the height of lance was larger than the distance LH.

Figure 11:
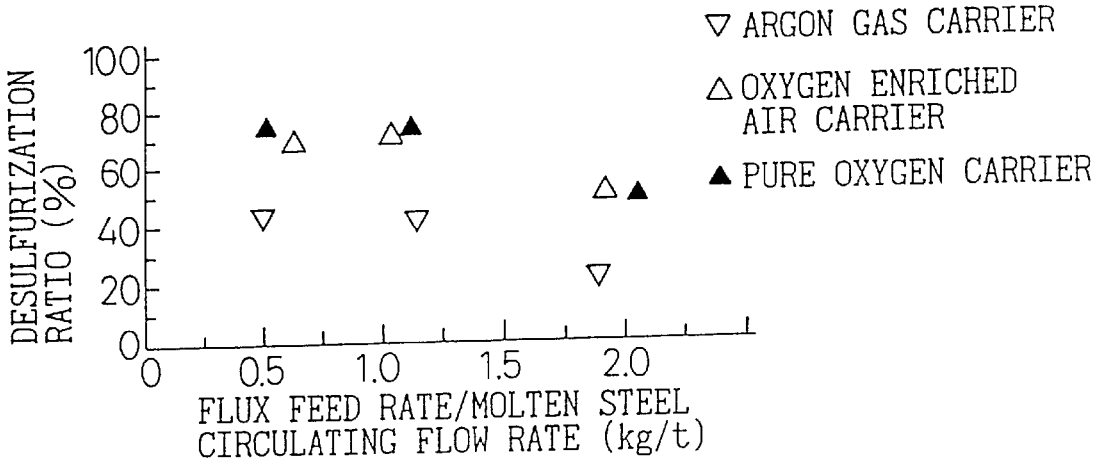
FIG. 11 is a diagram showing the relationship between the ratio of the flux feed rate to the circulating flow rate of the molten steel and the desulfurization ratio in the apparatus shown in FIG. 3.

The results are shown in FIG. 11. As is apparent from FIG. 11, despite the fact that the flux has a composition (20% $CaF_2$) which is less likely to be melted and has poor reactivity, the use of an oxygen-containing carrier gas can offer a desulfurization ratio comparable to that provided by using a flux having a composition of 40% $CaF_2$ (see FIG. 9) in combination with the argon carrier gas, and a high desulfurization ratio can be stably maintained at an F/Q value of not more than 1.5. Further, as is apparent from the drawing, regarding the carrier gas, oxygen enriched air and pure oxygen offered higher desulfurization ratio than argon. The reason why a high desulfurization ratio can be attained despite the use of a flux having poor meltability is believed to reside in that, as described above, the use of the oxygen enriched air as the carrier gas permits the flux temperature to be raised before the entry into the molten steel and, hence, gives rise to rapid diffusion of S, contained in the molten steel, in the interior of the flux upon the entry of the flux into the molten steel, accelerating the desulfurization reaction. A change of the carrier gas for the refining flux from the argon gas, an inert gas, to oxygen enriched air or pure oxygen gas offers higher temperature of the burner flame produced below the lower end of the lance and above the surface of the molten steel than that in the use of the inert gas. The increased flame temperature leads to increased temperature of the refining flux at the time of arrival of the refining flux at the surface of the molten steel, further increasing the rate of diffusion of [S] into the interior of the flux.

Further, the present inventors have conducted the same test (desulfurizer: 80% CaO-20% $CaF_2$, 2 kg/ton) using the vacuum refining apparatus and system shown in FIGS. 1 and 2.

Figure 10:
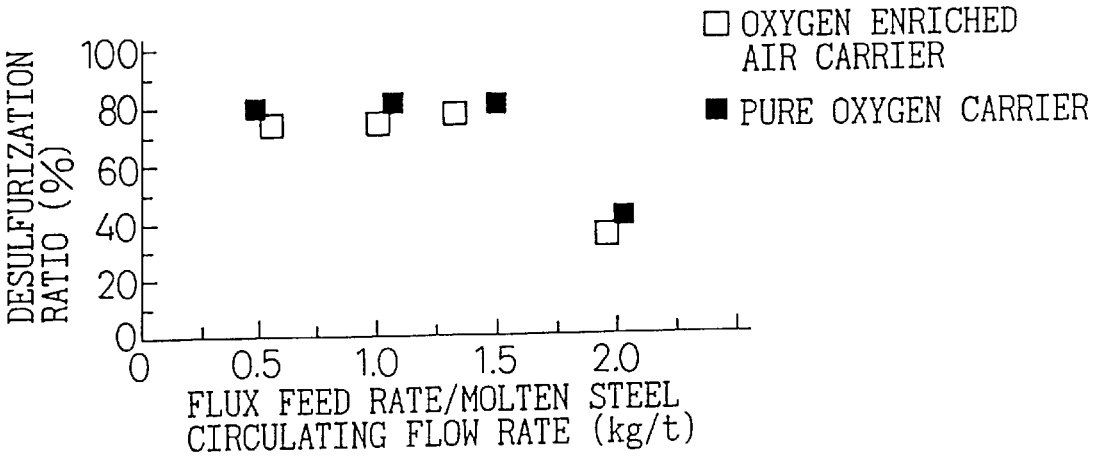
FIG. 10 is a diagram showing the relationship between the ratio of the flux feed rate to the circulating flow rate of the molten steel and the desulfurization ratio in the apparatus shown in FIG. 1.

The test results are shown in FIG. 10. As with the results shown in FIG. 11, despite the fact that the flux has a composition which is less likely to be melted and has poor reactivity, the use of oxygen enriched air (degree of oxygen enrichment: 60%) as the oxygen-containing gas can ensure a desulfurization ratio comparable to that provided by using an argon gas and a flux having good meltability (40% $CaF_2$) (see FIG. 9), and a high desulfurization ratio can be stably ensured at an F/Q value of not more than 1.5. Further, despite the fact that the flux used has a composition which is less likely to be melted and has poor reactivity, the use of pure oxygen gas as the oxygen containing-gas can ensure a desulfurization ratio equal or superior to that provided by using a flux having good meltability (40% $CaF_2$), and a high desulfurization ratio can be stably ensured at an F/Q value of not more than 1.5.

The reason why the use of a top-blown lance, wherein a fuel gas and a pure oxygen gas can be simultaneously ejected to form a burner flame below the lance and above the surface of the molten steel, in combination with the pure oxygen gas as a carrier gas for a desulfurizing flux can offer the highest desulfurization ratio on an identical flux composition basis, is that the temperature of the flame produced is higher than that of the flame produced by using oxygen enriched air and, as compared with the top-blown lance incorporating a flux introduction pipe, the above top-blown lance permits the flux powder to be more homogeneously dispersed in the burner flame, offering more homogeneous heating.

As described above, the use of a top-blown lance, which can simultaneously eject a fuel gas, an oxygen-containing gas, and a flux with the aid of a carrier gas, in combination with simultaneous ejection of the fuel gas, the oxygen-containing gas, and the flux with the aid of the carrier gas through the lance while maintaining a ratio of the flux feed rate to the circulating flow rate of the molten steel in the range of from 0.5 to 1.5 to form a burner flame above the surface of the molten steel and, at the same time, heating of the flux through the burner flame followed by arrival of the heated flux at the surface of the molten steel, or alternatively the use of a top-blown lance, which can simultaneously eject a fuel gas and an oxygen-containing gas to form a burner flame above the surface of the molten steel and heating of a flux through the burner flame followed by arrival of the heated flux at the surface of the molten steel, can ensure a desulfurization ratio, in the use of a flux having a lower $CaF_2$ content, equal or superior to that provided by a method wherein a flux having a higher $CaF_2$ content is passed through the top-blown lance with the aid of a carrier gas, e.g., an inert gas, such as an argon or nitrogen gas, or other carrier gas, and, without heating, allowed to arrive at the surface of the molten metal. Further, by virtue of the use of the flux having a lower $CaF_2$ content, the melt loss of the refractory can be reduced and the molten steel and the refractory can be stably heated.

Further, as with the refining with a flux, the above top-blown lance can be suitably used as a burner during vacuum treatment (vacuum degassing) excluding the desulfurization period to conduct burner heating of the molten steel and the refractory of the vacuum tank, and, in addition, burner heating of the refractory of the vacuum tank can eliminate a problem of deposition of the matrix material onto the refractory of the vacuum tank in a waiting period of the vacuum treatment.

It is a matter of course that the technique where a high flux refining reaction is achieved throughout the period of single refractory life while maintaining the relationship between the flux feed rate F and the circulating flow rate Q of the molten steel so that the F/Q=0.5 to 1.5, can be applied to the blowing of the refining flux into the molten steel with the aid of an inert gas as a carrier gas.

Although desulfurization has been described as the refining process using a flux, the present invention is not limited to this only and can be utilized also in the blowing of an auxiliary raw material having a molten steel refining capability, for example, a flux powder for reducing oxygen and phosphorus on an ultra low level.

Further, regarding the vacuum refining apparatus, vacuum degassing tanks of DH type, straight barrel type and other types can be used besides the RH type vacuum degassing tank.

EXAMPLES

Example 1

RH vacuum degassing apparatuses and flux gas feed systems shown in FIGS. 1, 2, 3, and 4 were used to conduct vacuum refining with the target content of [S] in the molten steel being not more than 10 ppm.

The scale of the apparatus was 100 tons in terms of capacity, and a molten steel having a composition specified in Table 5 was desulfurized. The desulfurization conditions and the results of the treatment are summarized in Tables 6 and 7. The flux used had a composition of 80% lime and 20% fluorspar and a particle size of 100 mesh or less. A top-blown lance 1 had a Laval structure having a throat diameter of 18 mm and an outlet diameter of 90 mm. The feed rate of the flux powder was 30 kg/min. The T. Fe content of slag was less than 6%. The temperature of a molten steel before the treatment was about 1590° C.

For comparison, an experiment was carried out using an RH vacuum degassing apparatus, wherein a top-blown lance 1 incorporating a refining flux introduction tube 5 shown in FIGS. 3 and 4 was ascendably and descendably disposed in the top of a tank, in the same manner as described above, except that an argon gas was used as a refining flux carrier gas.

For samples No. 1 to No. 5 listed in Table 6, which are examples of the present invention, powders passed through the burner flame were recovered and found to have glossy spherical appearance as shown in FIG. 13(A). The observation of the cross section thereof revealed that, as shown in FIG. 13(B), the element distribution of F and O besides Ca was uniform, confirming that the powder was in a melted state.

As is apparent from Table 7, for samples No. 1 to No. 5 (examples of the present invention), an increase in the temperature of the refining flux by virtue of an increase in temperature of the burner flame resulted in more efficient reaction of the refining flux than samples No. 6 and No. 7 (comparative examples), reducing the flux consumption and shortening the treatment time. Further, it is apparent that, as compared with samples No. 1 to No. 3, samples No. 4 and No. 5 are lower in flux consumption and shorter in treatment time. The difference in effect between samples No. 4 and No. 5 and samples No. 1 to No. 3 are derived from further increase in temperature and melting of the refining flux by virtue of the dispersion of the powder in a high-temperature flame.

TABLE 5

| C | Si | Mn | Sol.Al |
|---|---|---|---|
| 0.0030% | 3.0% | 0.20% | 0.300 |

TABLE 6

| Sample No. | Oxygen flow rate, $Nm^3/hr$ | LNG flow rate, $Nm^3/hr$ | Lance height, mm | Powder feed conditions: Form*) | Powder feed conditions: Kind of carrier gas | Powder feed conditions: Flow rate of carrier gas**), $Nm^3/hr$ | Remarks |
|---|---|---|---|---|---|---|---|
| 1 | 460 | 200 | 6000 | A | Oxygen | 180 | Inv. |
| 2 | 460 | 200 | 5000 | A | Oxygen | 170 | Inv. |
| 3 | 368 | 160 | 4500 | A | Oxygen | 140 | Inv. |
| 4 | 460 | 200 | 6000 | B | Oxygen | 180 | Inv. |
| 5 | 550 | 240 | 6200 | B | Oxygen | 200 | Inv. |
| 6 | 460 | 200 | 5000 | A | Argon | 180 | Comp. |

TABLE 6-continued

| Sample No. | Oxygen flow rate, $Nm^3/hr$ | LNG flow rate, $Nm^3/hr$ | Lance height, mm | Powder feed conditions: Form*) | Powder feed conditions: Kind of carrier gas | Powder feed conditions: Flow rate of carrier gas**), $Nm^3/hr$ | Remarks |
|---|---|---|---|---|---|---|---|
| 7 | 460 | 200 | 6000 | A | Argon | 180 | Comp. |

Note:
*)Form of powder feed
A: Fed into refining flux introduction pipe incorporated in top-blown lance
B: Fed into pipe for feeding oxygen into burner lance
**)Numerical value of the flow rate of carrier gas. When the carrier gas is oxygen, the flow rate is expressed in terms of the flow rate of oxygen gas as the carrier gas in the total flow rate of the oxygen gas used.

TABLE 7

| Sample No. | Flux consumption, kg/t | [S] Before, ppm | [S] After, ppm | Treatment time, min | Temp. compensation during desulfurization*) ° C. | Remarks |
|---|---|---|---|---|---|---|
| 1 | 2.1 | 27 | 8 | 7.0 | 11 | Inv. |
| 2 | 2.0 | 31 | 9 | 6.7 | 10 | Inv. |
| 3 | 2.1 | 24 | 8 | 7.0 | 9 | Inv. |
| 4 | 1.7 | 30 | 6 | 5.7 | 8 | Inv. |
| 5 | 1.6 | 37 | 7 | 5.3 | 10 | Inv. |
| 6 | 3.1 | 37 | 9 | 10.3 | Base | Comp. |
| 7 | 3.2 | 34 | 9 | 10.7 | Base | Comp. |

Note: *). . . Value based on temperature compensation in comparative example.

Example 2

A molten steel having a composition specified in Table 2 was vacuum-desulfurized using a pure oxygen gas as the oxygen-containing gas in a 100-ton RH vacuum degassing apparatus, shown in FIG. 1, equipped with a top-blown lance 1 shown in FIG. 2. Vacuum desulfurization conditions are summarized in Table 8.

The flux used had a composition of 60% lime and 40% fluorspar and a particle size of 100 mesh or less. The top-blown lance 1 had a throat diameter of 18 mm and an outlet diameter of 90 mm. The flow rate of the pure oxygen gas was 460 $Nm^3/hr$, and LNG was spouted through a fuel feed hole at a flow rate of 200 $Nm^3/hr$. Desulfurization was carried out under conditions of a T. Fe+MnO content of slag of not more than 5.0%. The [S] content of the molten steel after the treatment was not more than 10 ppm.

TABLE 8

| | Period of single refractory life of vacuum tank | Powder feed rate, kg/min (F) | Circulating flow rate of molten steel, ton/min (Q) | F/Q, kg/t | Molten steel [S] Before treatment, ppm | Molten steel [S] After treatment, ppm | Desulfurization ratio, % | Flux consumption, kg/t | Powder feed time, min | Degree of vacuum, torr |
|---|---|---|---|---|---|---|---|---|---|---|
| Ex. | Early | 52 | 35 | 1.49 | 38 | 7 | 82 | 2.1 | 4.0 | 5 |
| | Middle | 61 | 41 | 1.49 | 50 | 10 | 80 | 1.9 | 3.1 | 5 |
| | Last | 78 | 52 | 1.50 | 45 | 9 | 80 | 1.8 | 2.3 | 5 |
| Comp. | Early | 70 | 35 | 2.00 | 38 | 8 | 78 | 4.3 | 6.1 | 5 |
| | Middle | 70 | 42 | 1.67 | 35 | 7 | 80 | 3.1 | 4.4 | 5 |
| | Last | 70 | 51 | 1.37 | 43 | 9 | 70 | 1.9 | 2.7 | 5 |

Further, each time when the treatment is initiated, the inner diameter of the RH immersion pipe was measured to calculate the estimated circulating flow rate of the molten steel, and the flux feed rate was regulated so that the ratio of the flux feed rate (kg/min) to the circulating flow rate of the molten steel (t/min) was 1.5. For comparison, an experiment was carried out wherein the inner diameter of the RH immersion pipe was not measured and the flux was fed at a constant rate (the maximum capacity for the flux feed rate in the system) throughout the period of single refractory life of the RH vacuum tank.

For the examples of the present invention, the unit requirement of flux was always low throughout the period of single refractory life of the RH vacuum tank. Further, for the examples of the present invention, as compared with the comparative examples, the effect of shortening the treatment time was significant particularly in the early and middle periods of the single refractory life of the RH vacuum tank.

INDUSTRIAL APPLICABILITY

As described above, according to the present invention, the reaction efficiency of the refining flux can be improved over that in the conventional burner heating and refining flux projection method. This can reduce the refining flux consumption throughout a period of single refractory life of the vacuum tank, offering advantages such as shortened treatment time and reduced melt loss of the refractories. Thus, the present invention has great industrial applicability.

We claim:

1. A vacuum refining apparatus for molten steel comprising:

a vacuum degassing tank, with said vacuum degassing tank having a top end and a lower end;

a top-blown lance having a center portion, said top-blown lance movably mounted at said top end of said vacuum degassing tank for selectively ascending and descending in said vacuum degassing tank;

a ladle located below said vacuum degassing tank for holding molten metal with said lower end of said vacuum degassing tank being received by said ladle for immersion of said lower end of said vacuum degassing tank in said molten metal;

an oxygen gas passageway located in said center portion of said top-blown lance;

an oxygen carrier gas feed pipe for carrying oxygen carrier gas, said oxygen gas feed pipe connected in fluid communication with said oxygen gas passageway;

a refining flux tank connected in fluid communication with said oxygen carrier gas feed pipe through a valve for feeding refining flux to said oxygen carrier gas feed pipe and then to said oxygen gas passageway;

a combustion chamber located at a lower end of said top-blown lance and in fluid communication with said oxygen gas passageway;

a fuel gas passageway located in a wall body of said top-blown lance, said fuel gas passageway having a discharge spout located at said combustion chamber of said top-blown lance for discharging fuel gas into said combustion chamber;

said combustion chamber at said lower end of said top-blown lance being in fluid communication with said vacuum degassing tank.

2. An apparatus according to claim 1 further comprising:

a refining flux introduction pipe disposed within said oxygen gas passageway, said refining flux introduction pipe having a discharge spout located at a lower end of said refining flux introduction pipe for discharging oxygen carrier gas and refining flux into said combustion chamber;

said oxygen carrier gas feed pipe connected in fluid communication with said refining flux introduction pipe.

3. A process for vacuum refining a molten steel, comprising the steps of:

providing a vacuum refining apparatus having a vacuum degassing tank, with said vacuum degassing tank having a top;

mounting a top-blown lance having a center portion at the top of said vacuum degassing tank for selective ascending and descending movement in said vacuum degassing tank;

providing an oxygen gas passageway in said center portion of said top-blown lance;

providing a combustion chamber at a lower end of said top-blown lance with said oxygen gas passageway being in fluid communication with said combustion chamber;

feeding oxygen gas and refining flux into said oxygen gas passageway and mixing said oxygen gas and refining flux in said oxygen gas passageway, with said oxygen gas functioning as a carrier gas for said refining flux, and then feeding said mixed oxygen gas and refining flux from said oxygen gas passageway into said combustion chamber at said lower end of said top-blown lance;

providing a fuel gas passageway in a wall body of said top-blown lance in fluid communication with said combustion chamber at said lower end of said top-blown lance;

feeding a fuel gas through said fuel gas passageway and then into said combustion chamber;

forming a flame between said combustion chamber and a surface of molten steel in said vacuum degassing tank by combusting said oxygen gas and said fuel gas;

passing said refining flux through said flame thereby heating and melting said refining flux;

discharging heat-melted refining flux to the surface of molten steel located in said vacuum degassing tank for refining said molten steel.

4. A process according to claim 3 further comprising feeding said refining flux from a refining flux tank into an oxygen carrier gas refining flux feed pipe having oxygen carrier gas flowing there through, and then feeding oxygen carrier gas and refining flux from said oxygen carrier gas refining flux feed pipe into said oxygen gas passageway in said center portion of said top blown lance.

5. The process according to claim 3, wherein the atmosphere in the vacuum degassing tank is evacuated to 3 to 200 torr.

6. The process according to claim 3, wherein, when the refining flux is heated, heat in a quantity of not less than 670 kcal per kg of the refining flux powder is fed into the flame.

7. The process according to claim 3, wherein the particle diameter of the refining flux powder is not more than 0.25 mm.

8. The process according to claim 3, wherein the distance LH (mm) between the combustion chamber at the lower end of the top-blown lance and the surface of the molten steel is brought to a value determined by the following formula:

$$LH>3500-6.18\times D_2+224\times(D_2/D_1)+1.13\times F-11.58\times P$$

wherein $D_1$ represents the diameter of a lance throat, mm; $D_2$ represents the diameter of the output of the lance, mm; F represents the flow rate of oxygen, $Nm^3/hr$; and P represents the pressure of atmosphere, torr.

9. The process according to claim 3, wherein the refining flux has a melting point of 2,000° C. or below.

10. The process according to claim 3, wherein the refining is carried out so that the rate of feed of the refining flux into the molten steel and the rate of circulating flow of the molten steel within the vacuum refining apparatus satisfy the following requirement:

0.5≦refining flux feed rate (kg/min)/circulating flow rate of molten steel (ton/min)≦1.5.

11. A process for vacuum refining a molten steel, comprising the steps of:

providing a vacuum refining apparatus having a vacuum degassing tank, with said vacuum degassing tank having a top;

mounting a top-blown lance having a center portion at the top of said vacuum degassing tank for selective ascending and descending movement is said vacuum degassing tank;

providing an oxygen gas passageway at a lower end of said top-blown lance with said oxygen gas passageway being in fluid communication with said combustion chamber;

feeding oxygen gas into said oxygen gas passageway, and then feeding said oxygen gas from said oxygen gas passageway into said combustion chamber at said lower end of said top-blown lance;

providing a refining flux introduction pipe within said oxygen gas passageway, with said refining flux introduction pipe having a lower end in fluid communication with said combustion chamber;

feeding a refining flux carried by oxygen carrier gas into said refining flux introduction pipe and then into said combustion chamber;

providing a fuel gas passageway in a wall body of said top-blown lance in fluid communication with said combustion chamber at said lower end of said top-blown lance;

feeding a fuel gas through said fuel gas passageway and then into said combustion chamber;

forming a flame between said combustion chamber and a surface of molten steel in said vacuum degassing tank by combusting said oxygen gas and said fuel gas;

passing said refining flux through said flame thereby heating and melting said refining flux;

discharging heat-melted refining flux to the surface of molten steel located in said vacuum degassing tank for refining said molten steel.

12. A process according to claim 11 further comprising feeding said refining flux from a refining flux tank into an oxygen carrier gas feed pipe having oxygen carrier gas and refining flux from said oxygen carrier gas feed pipe into said refining flux introduction pipe.

13. The process according to claim 11, wherein the atmosphere in the vacuum degassing tank is evacuated to 3 to 200 torr.

14. The process according to claim 11, wherein, when the refining flux is heated, heat in a quantity of not less than 670 kcal per kg of the refining flux powder is fed into the flame.

15. The process according to claim 11, wherein the particle diameter of the refining flux powder is not more than 0.25 mm.

16. The process according to claim 11, wherein the distance LH (mm) between the combustion chamber at the lower end of the top-blown lance and the surface of the molten steel is brought to a value determined by the following formula:

$$LH>3500-6.18\times D_2+224\times(D2/D_1)+1.13\times F-11.58\times P$$

wherein $D_1$ represents the diameter of a lance throat, mm; $D_2$ represents the diameter of the output of the lance, mm; F represents the flow rate of oxygen, $Nm^3/hr$; and P represents the pressure of atmosphere, torr.

17. The process according to 11, wherein the refining flux has a melting point of 2,000° C. or below.

18. The process according to claim 11, wherein the refining is carried out so that the rate of feed of the refining flux into the molten steel and the rate of circulating flow of the molten steel within the vacuum refining apparatus satisfy the following requirement:

0.5≦refining flux feed rate (kg/min)/circulating flow rate of molten steel (ton/min)≦1.5.

* * * * *